US009475607B2

(12) United States Patent
Apps

(10) Patent No.: US 9,475,607 B2
(45) Date of Patent: Oct. 25, 2016

(54) PLASTIC BEER KEG

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 2147 days.

(21) Appl. No.: 12/243,742

(22) Filed: Oct. 1, 2008

(65) Prior Publication Data

US 2010/0077790 A1 Apr. 1, 2010

(51) Int. Cl.

| | |
|---|---|
| ***B65D 21/02*** | (2006.01) |
| ***A47J 39/00*** | (2006.01) |
| ***A47J 41/00*** | (2006.01) |
| ***B65D 81/38*** | (2006.01) |
| ***B65D 83/72*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 8/00*** | (2006.01) |
| ***B65D 6/38*** | (2006.01) |

(Continued)

(52) U.S. Cl.

CPC ..... *B65D 11/06* (2013.01); *B65D 11/24* (2013.01); *B65D 21/0233* (2013.01); *B65D 25/2897* (2013.01); *B65D 25/32* (2013.01); *B65D 43/0212* (2013.01); *B65D 77/0446* (2013.01); *B65D 77/0486* (2013.01); *B65D 81/3806* (2013.01); *F25D 3/08* (2013.01); *B65D 2543/005* (2013.01); *B65D 2543/00027* (2013.01); *B65D 2543/0074* (2013.01); *B65D 2543/00092* (2013.01); *B65D 2543/00296* (2013.01); *B65D 2543/00416* (2013.01); *B65D 2543/00537* (2013.01); *B65D 2543/00555* (2013.01); *B65D 2543/00629* (2013.01); *B65D 2543/00685* (2013.01); *B65D 2543/00796* (2013.01); *F25D 2303/0843* (2013.01); *F25D 2303/0844* (2013.01); *F25D 2331/802* (2013.01)

(58) Field of Classification Search

CPC .. B65D 11/06; B65D 11/24; B65D 21/0233; B65D 43/0212; B65D 2543/00027; F25D 2303/0843

USPC ..... 220/592.19, 23.87, 670, 737, 752

See application file for complete search history.

(56) References Cited

U.S. PATENT DOCUMENTS

| | | | | |
|---|---|---|---|---|
| 2,090,403 A * | 8/1937 | Murray et al. | ..... | 62/165 |
| 2,104,466 A * | 1/1938 | Marzolf | ..... | 62/166 |

(Continued)

FOREIGN PATENT DOCUMENTS

| | | |
|---|---|---|
| EP | 1095897 | 5/2001 |
| EP | 1947029 | 7/2008 |

(Continued)

OTHER PUBLICATIONS

European Search Report for EP Application No. 09171548.2, Dec. 15, 2009.

*Primary Examiner* — Fenn Mathew
*Assistant Examiner* — Andrew T Kirsch
(74) *Attorney, Agent, or Firm* — Carlson, Gaskey & Olds PC

(57) ABSTRACT

A plastic beer keg includes an outer container and an inner liner. A removable lid is secured over an opening to the container to enclose the liner. In use, the lid can be removed and ice placed in the container directly on the liner, ice flows into gaps between the liner and the container to provide rapid cooling of the content of the liner.

30 Claims, 14 Drawing Sheets

(51) Int. Cl.

| | |
|---|---|
| ***B65D 25/28*** | (2006.01) |
| ***B65D 25/32*** | (2006.01) |
| ***B65D 43/02*** | (2006.01) |
| ***B65D 77/04*** | (2006.01) |
| ***F25D 3/08*** | (2006.01) |

(56) References Cited

U.S. PATENT DOCUMENTS

| | | | | | |
|---|---|---|---|---|---|
| 2,447,390 | A | * | 8/1948 | Brand | 165/154 |
| 3,768,706 | A | * | 10/1973 | Hill | 222/325 |
| 3,825,145 | A | | 7/1974 | Reynolds | |
| 3,827,595 | A | | 8/1974 | Reynolds | |
| 3,908,871 | A | | 9/1975 | Gottwald | |
| 3,952,904 | A | | 4/1976 | Verlinden | |
| 4,032,047 | A | | 6/1977 | Wilson | |
| 4,482,067 | A | | 11/1984 | Saito et al. | |
| 4,491,247 | A | | 1/1985 | Nitchman | |
| 4,519,219 | A | | 5/1985 | Prepodnik et al. | |
| 4,531,656 | A | | 7/1985 | Nitchman | |
| 4,775,072 | A | * | 10/1988 | Lundblade et al. | 220/766 |
| 4,867,348 | A | | 9/1989 | Dorfman | |
| 5,129,534 | A | | 7/1992 | Dunn | |
| 5,267,669 | A | | 12/1993 | Dixon et al. | |
| 5,375,741 | A | * | 12/1994 | Harris | 222/105 |
| 5,597,085 | A | | 1/1997 | Rauworth et al. | |
| 5,897,016 | A | | 4/1999 | Wheaton | |
| 6,196,277 | B1 | | 3/2001 | Till | |
| 6,260,823 | B1 | | 7/2001 | Weber | |
| 6,308,858 | B1 | | 10/2001 | Koefelda | |
| 6,343,916 | B1 | | 2/2002 | Bougamont et al. | |
| 6,415,959 | B1 | | 7/2002 | Bougamont et al. | |
| 6,626,314 | B1 | | 9/2003 | McHenry et al. | |
| 6,666,358 | B1 | | 12/2003 | Field | |
| 6,748,789 | B2 | | 6/2004 | Turner et al. | |
| 6,751,981 | B1 | | 6/2004 | Burnette | |
| 6,805,267 | B2 | | 10/2004 | Bougamont et al. | |
| 7,044,292 | B2 | * | 5/2006 | Nall | 206/216 |
| 7,134,578 | B2 | | 11/2006 | Bougamont et al. | |
| 7,174,762 | B2 | | 2/2007 | Turner et al. | |
| 7,455,082 | B2 | | 11/2008 | Monzel | |
| 7,546,935 | B2 | | 6/2009 | Wheaton | |
| 2004/0026461 | A1 | | 2/2004 | Bougamont et al. | |
| 2006/0049213 | A1 | | 3/2006 | Wheaton | |
| 2008/0251542 | A1 | | 10/2008 | Rossignol | |
| 2008/0277001 | A1 | | 11/2008 | Wheaton | |
| 2009/0206505 | A1 | | 8/2009 | Monzel et al. | |
| 2009/0320264 | A1 | | 12/2009 | Berger et al. | |
| 2010/0264140 | A1 | | 10/2010 | Apps | |
| 2011/0017737 | A1 | | 1/2011 | Apps | |
| 2011/0180535 | A1 | | 7/2011 | Apps | |

FOREIGN PATENT DOCUMENTS

| | | |
|---|---|---|
| EP | 2281753 | 2/2011 |
| FR | 2665688 | 2/1992 |
| GB | 437295 | 10/1935 |
| GB | 2182319 | 5/1987 |
| GB | 2188040 | 9/1987 |
| GB | 2209740 | 5/1989 |
| GB | 2283967 | 5/1995 |
| WO | 9112196 | 8/1991 |
| WO | 2004063087 | 7/2004 |
| WO | 2006110948 | 10/2006 |
| WO | 2008/013819 | 1/2008 |
| WO | 2008083782 | 7/2008 |

* cited by examiner

PLASTIC BEER KEG

BACKGROUND OF THE INVENTION

The present invention relates generally to large multiple serving beverage containers, in particular, beer kegs.

Metal beer kegs primarily made of stainless steel have been the preferred method of transporting draft beer from the brewery to the retailer (i.e. restaurant, bar, store) for many years. They come in several sizes, between a sixth barrel and a half barrel.

Metal kegs are very durable and can give many years of service. However, they have a high initial purchase price and several additional costs during use. First, shipping an empty keg back to the brewery increases the actual cost of using stainless steel or metal beer kegs. Next, the keg must be prepared for refilling, including being emptied, inspected, pressure checked, precleaned with water, cleaned with a caustic rinse, steam sterilized and evacuated with $CO_2$ before it can be refilled. Damaged kegs must also be repaired as needed at this time.

The high cost of stainless steel has made it profitable for thieves to steal empty kegs and sell them for scrap. The cost of lost or stolen kegs further increases the cost of using metal beer kegs.

Most bottle or can beer is pasteurized, which is why it can be stored and sold at room temperature. The pasteurization also gives it a longer shelf life. Outside of the U.S., it is more common for keg beer to be pasteurized. In the U.S., most keg beer is not pasteurized. This means it must be kept cold from the time the keg is filled to the time it is emptied. Thus, there is another additional cost to the system to keep the keg beer refrigerated during transport and storage.

Beer spoils quickly once it is exposed to air. A keg that uses air for draft pressure will typically spoil within a few days. Commercial systems and the better home systems use $CO_2$ as the preferred gas to pressurize the kegs and force the beer to flow. $CO_2$ does not react with the beer and allows beer to remain fresh over several weeks.

Although draft beer is often available at restaurants and bars, however, it is difficult to sell draft beer for home consumption at a reasonable price. One obstacle to providing draft beer for the home market is the weight of a full keg of beer. A standard keg weighs approximately 160 pounds full and a pony keg (quarter barrel) weighs about 87 pounds full. Most stores also require an expensive deposit for the keg, which further inhibits the take-home market. The shape and size of kegs makes it difficult for the home user to refrigerate the keg without specialized coolers or refrigerators. Also, a typical home user does not have a $CO_2$ system, which is required if the beer is to be consumed over longer than a weekend.

There are some proposed designs for one-way kegs. One design uses a combination of a PET bottle and a cardboard box with a valve/spear design. Another design uses a similar concept but replaces the valve/spear assembly with a bag. Neither design is all plastic.

One plastic one-way beer keg includes a blow-molded PET container (bottle), which contains the beer. A spear/valve assembly allows the keg to be filled and dispensed. A blow-molded outer container protects the bottle from damage and allows the package to be transported. A lid securely attaches to the valve and outer and inner containers to form a rigid package that protects the beer inside. The design looks like a traditional metal keg and works with existing equipment that interfaces with metal kegs. However, this design is still expensive, and much more expensive than returnable kegs. Further, the inner and outer shells act together as an insulation barrier. For pasteurized beer, which may be warm when purchased, this makes it much more difficult for the consumer to cool the beer. In addition, due to the shape of the liner and outer/inner shell combination, the beer volume is roughly half that of a similarly sized metal keg.

SUMMARY OF THE INVENTION

The present invention provides a consumer friendly plastic keg. The keg includes an outer container body having a base. Tapered walls extend upwardly from a periphery of the base to a container mouth. Empty outer containers are nestable with one another to facilitate warehousing and transportation. A liner or bottle is received within the outer container.

A lid may be removably secured to an upper end of the outer container, thereby enclosing the liner. Handles may be provided to facilitate carrying and transport.

According to another feature of the present invention, there may be at least one vertical gap between the liner and the container. Thus, the lid can be removed during use and ice can be placed inside the outer container between the outer container wall and the liner, thus providing more direct cooling of the beer inside the liner. Alternatively, the gap provides increased airflow for cooling. In one embodiment of the present invention, portions of the walls of the outer container are stepped inward to provide the gaps. In another embodiment, portions of the liner are stepped to provide gaps. In another embodiment, the container has a cross section with corners which provide gaps.

After use, the liner can be removed and recycled. The remaining outer container and lid can be used for storage of other items by the consumer. Alternatively, empty outer containers can be nested with one another and returned for reuse, or recycled.

These and other features of the application can be best understood from the following specification and drawings, the following of which is a brief description.

DETAILED DESCRIPTION OF THE PREFERRED EMBODIMENTS

Figure 1:
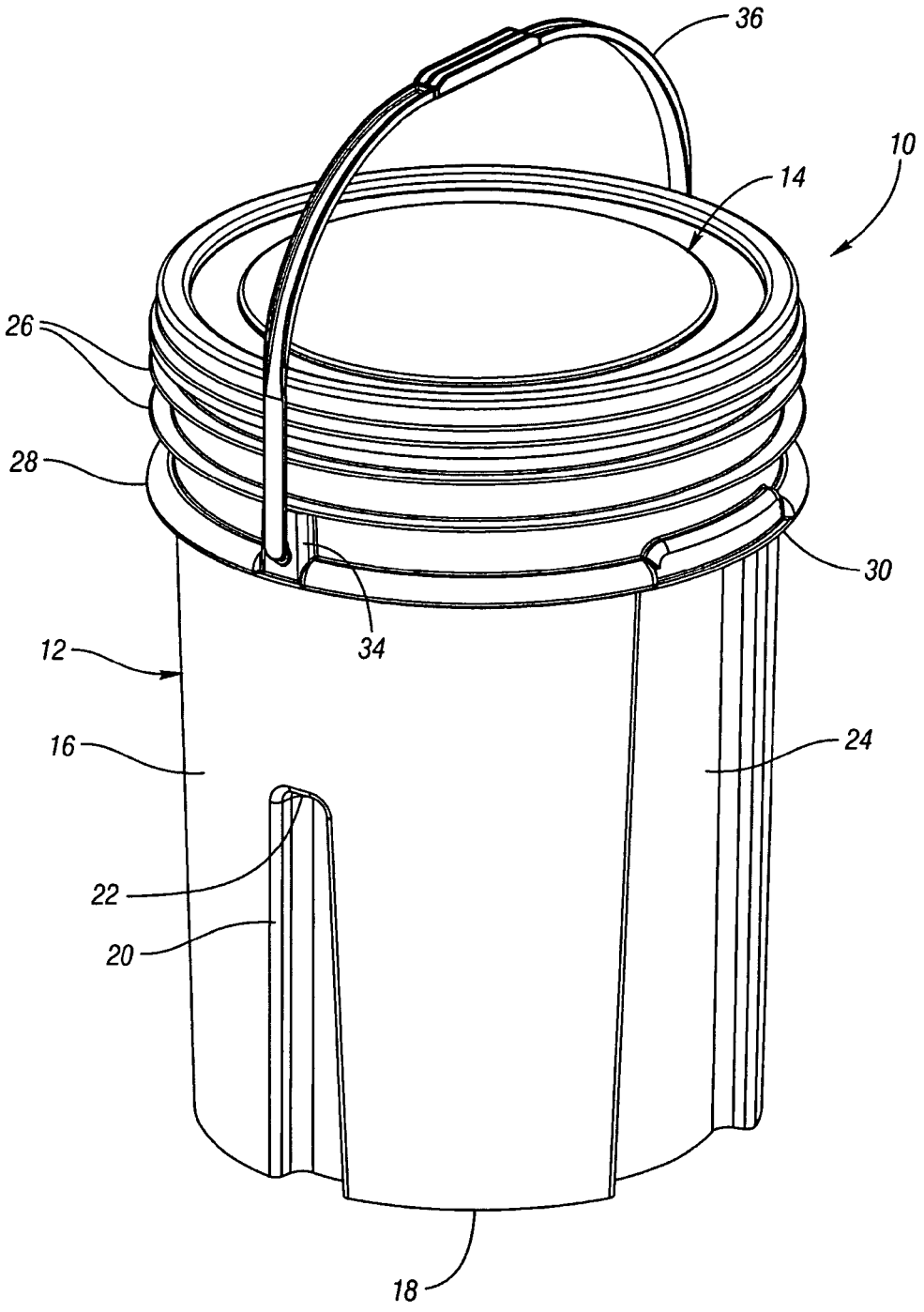
FIG. 1 is a perspective view of a plastic keg according to a first embodiment of the present invention.

FIG. 1 illustrates a plastic one-way beer keg 10 according to a first embodiment of the present invention. The plastic beer keg 10 includes an outer container 12 having a removable lid 14. The outer container 12 has an outer wall 16 extending upward from a periphery of a base 18. The plastic beer keg 10 is symmetric, such that the side not in view of FIG. 1 is symmetric to that of FIG. 1.

The wall 16 includes a pair of first recesses 20 extending upward approximately half the height of the container 12. Each of the first recesses 20 has an upper end 22. A pair of second recesses 24 extend from the base 18 up to a skirt 28. A pair of annular ribs 26 extend outward from the wall 16 above the skirt 28 to increase the rigidity of the container mouth. A handle 30 is formed in the skirt 28 above each of the second recesses 24. A handle attachment wall 34 is formed between the skirt 28 and one of the annular ribs 26 for attachment of a pivoting handle 36.

It should be noted that the container 12 is generally in the form of a pail, which provides several advantages as will be described below. The recesses 20, 24 also provide particular advantages in the context of the beer keg 10. It should be noted that, in general, the familiar form factor of the pail with removable lid and pivoting handle provides many of the advantages of the present invention beer keg 10, including nestability of the containers 12 with one another, ease of carrying, removability and replacability of the lid 14, and reusability of the container 12 and lid 14. This also provides advantages to the extent that there are existing technologies for the manufacture, labeling and handling of pails generally. The container 12 and lid 14 may be HDPE, polypropylene or other suitable materials.

Figure 2:
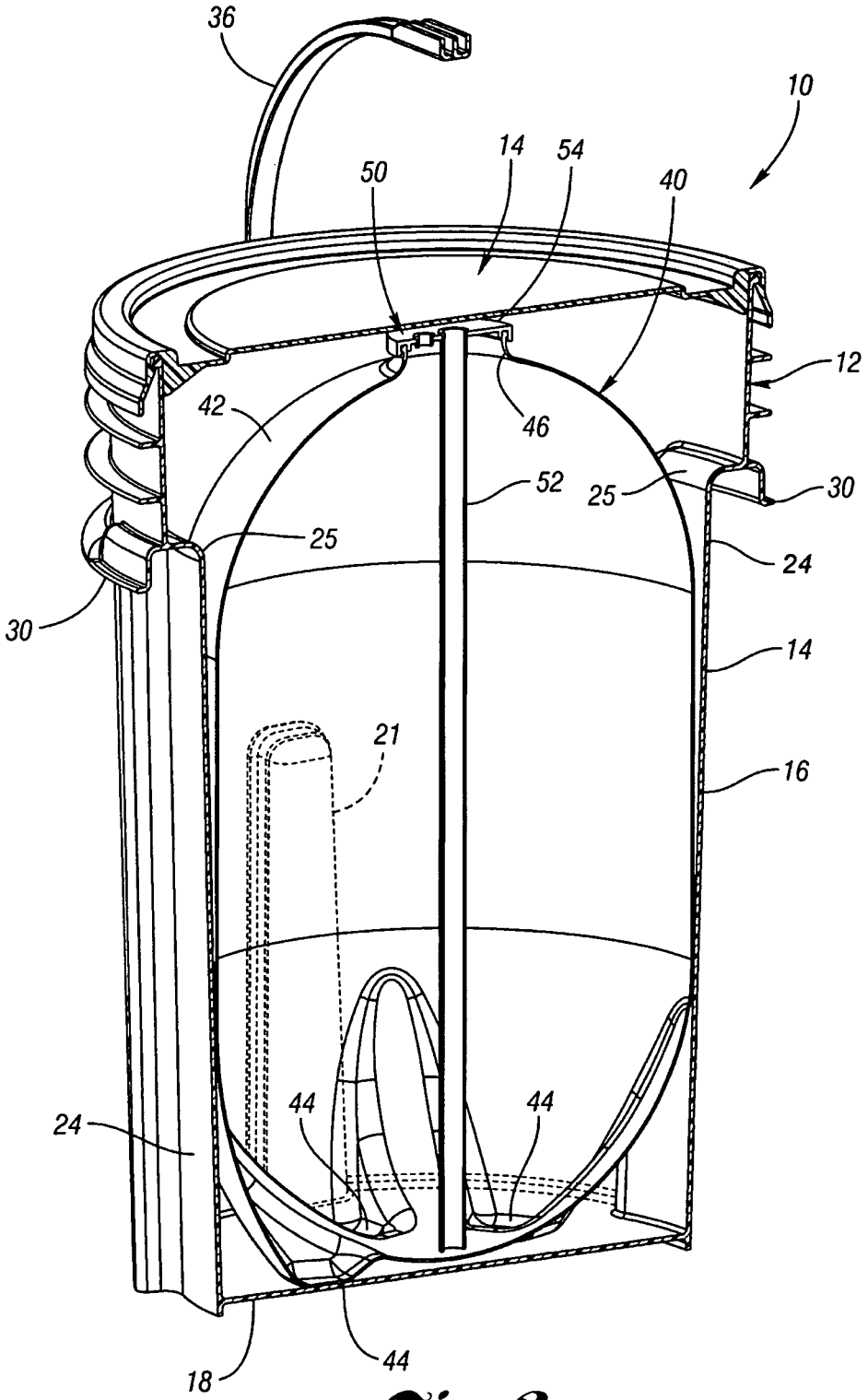
FIG. 2 illustrates the plastic keg of FIG. 1 broken away.

FIG. 2 illustrates the beer keg 10 of FIG. 1 partially broken away. A liner 40 (or "bottle") has an outer wall 42, which generally matches the shape of the interior of the container 12. The liner 40 may be PET or other suitable material. As is known with PET beverage bottles, the liner 40 is provided with a base having a plurality of feet 44, to make the liner stable for stacking, shipping and conveying. Preferably, the outer wall 42 of the liner 40 is even tapered to match the taper of the walls 16 of the container 12 to maximize volume for beverage. As shown, the second recesses 24 in the walls 16 of the container 12 define corresponding stepped-in portions or corrugations 25 in the interior of the container 12. Similarly, the first recesses 20 (FIG. 1) define corresponding stepped-in portions or corrugations 21 (one shown in FIG. 2). The liner 40 fits inside the container 12 snugly between the corrugations 21, 25. The feet 44 of the liner 40 rest on the base wall 18 of the container 12. The liner 40 includes a mouth 46 at an upper end, which reaches near an upper most edge of the mouth of the container 12, just below the lid 14.

A valve/spear assembly 50 is secured to the mouth 46 of the PET bottle 40. The valve/spear assembly 50 includes a spear 52 extending downwardly to the bottom of the liner 40 from a valve 54 at the liner 40 mouth 46.

Figure 3:
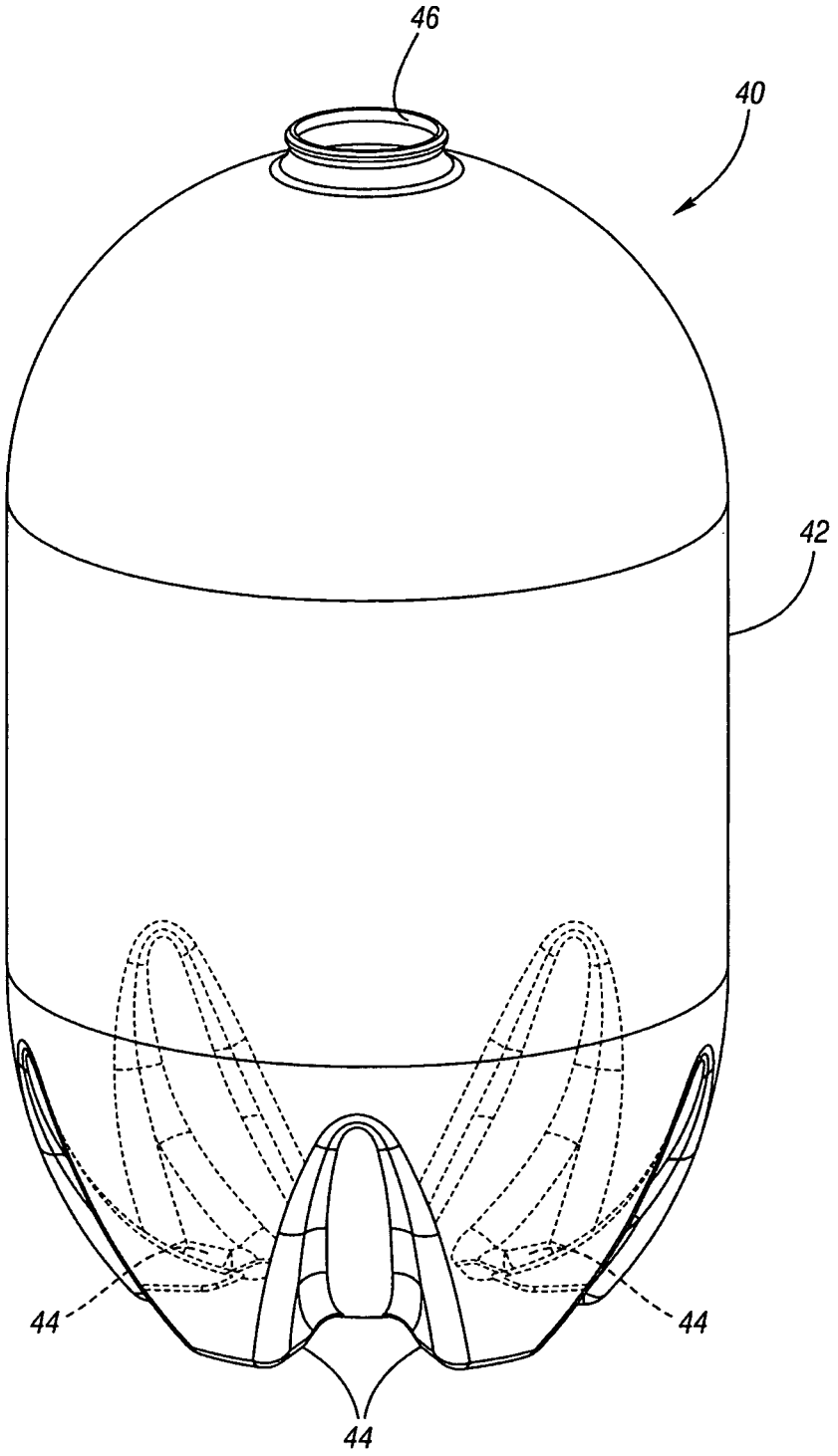
FIG. 3 is a perspective view of the liner of FIG. 2.

The liner 40 is shown by itself in FIG. 3. Again, the liner 40 includes a mouth 46 at an upper end of a container wall 42. The feet 44 are formed at a bottom end of the liner 40, such that the liner 40 can stand upright.

Figure 4:
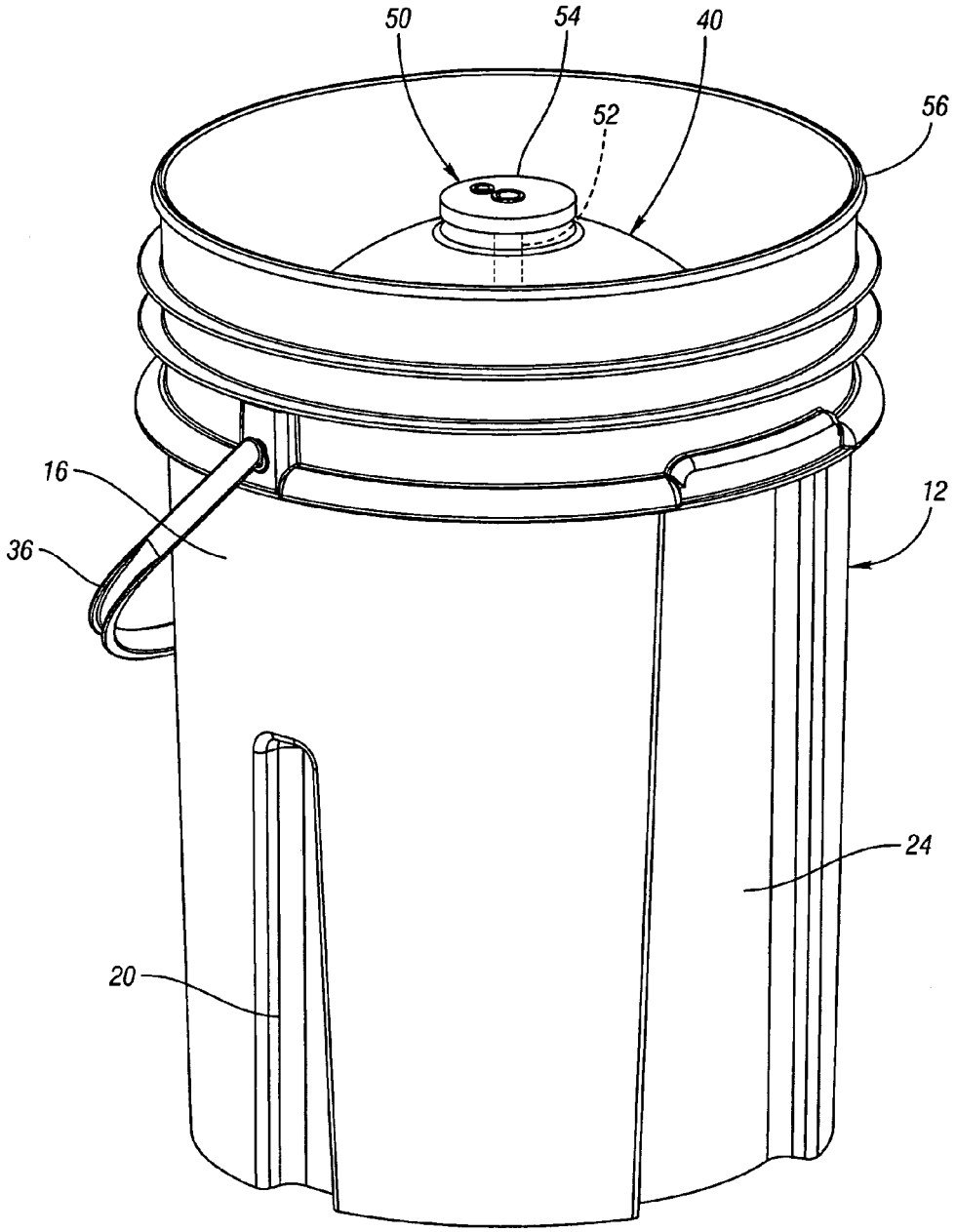
FIG. 4 illustrates the plastic keg of FIG. 1 with the lid and handle removed.

FIG. 4 is a perspective view of the liner 40 inside the container 12. During use, the user brings the beer keg 10 home and removes the lid 14 (FIG. 1). This exposes the valve/spear assembly 50 at the top of the container 12. As shown, the upper edge of the walls 16 of the container 12 includes a lip 56 for securing the lid 14 to the container 12.

Figure 5:
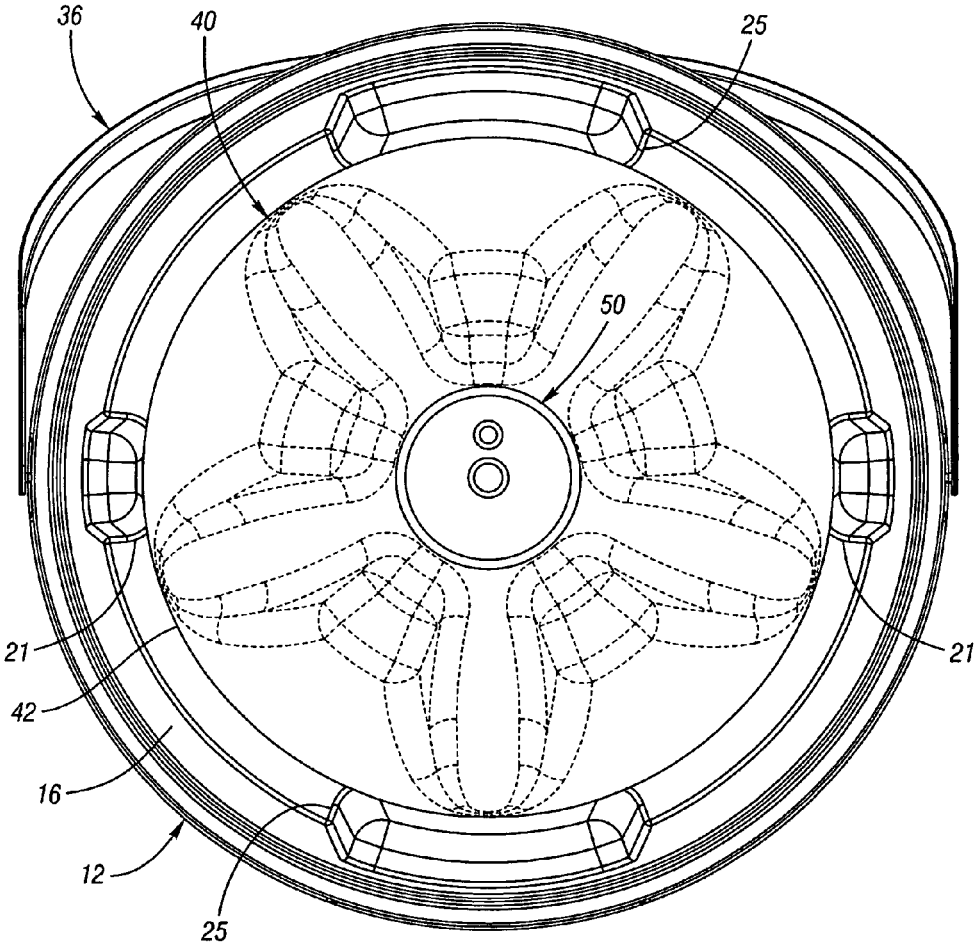
FIG. 5 is a top view of the plastic keg of FIG. 1 with the lid removed.

FIG. 5 is a top view of the container 12 and liner 40 of FIG. 4. As shown, the liner 40 fits snugly between the corrugations 25 and the corrugations 21 within the container 12. This provides gaps between the liner wall 42 and the container wall 16. Whereas in the prior art, this gap would provide an insulative property, which would inhibit cooling of the beer within the liner 40, in the present invention this provides the advantage of facilitating cooling of the beer in the liner 40. The user dumps ice directly on the liner 40 within the container 12. This ice slides down into the gap between the container wall 16 and the liner wall 42, as does the water from the melted ice, thereby providing rapid cooling to the beer within the liner 40. In particular, the ice and water flow to the bottom of the container 12, from which the beer is drawn. If the beer within the liner is pasteurized, then it may be sold warm, in which case the user would want to cool the beer within the liner 40 as quickly as possible. Alternatively, by remove the lid and placing the container 12 and liner 10 in a refrigerator, cold air can easily flow through the gaps around the liner 10.

Alternatively, the gaps can be eliminated by eliminating the corrugations 21, and increasing the size of the liner 40 to match the inner diameter of the container 12. This would increase the volume of beer within the liner 40, for applications where rapid cooling is not necessary, such as commercial applications where plastic kegs would be stored in coolers.

Figure 6:
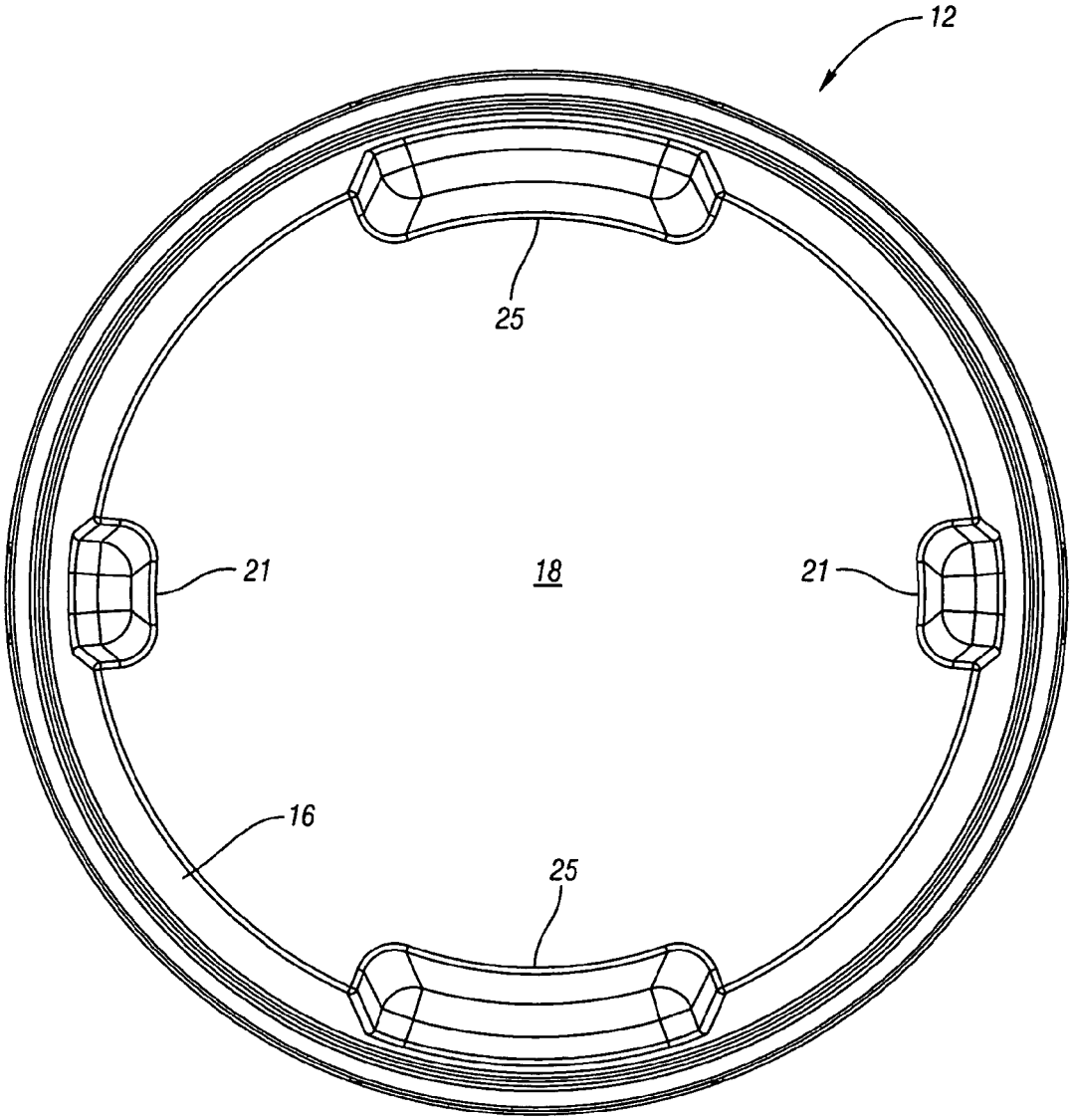
FIG. 6 is a bottom view of the outer container of FIG. 1.

FIG. 6 is a bottom view of the container 12, illustrating the corrugations 21, 25.

Figure 7:
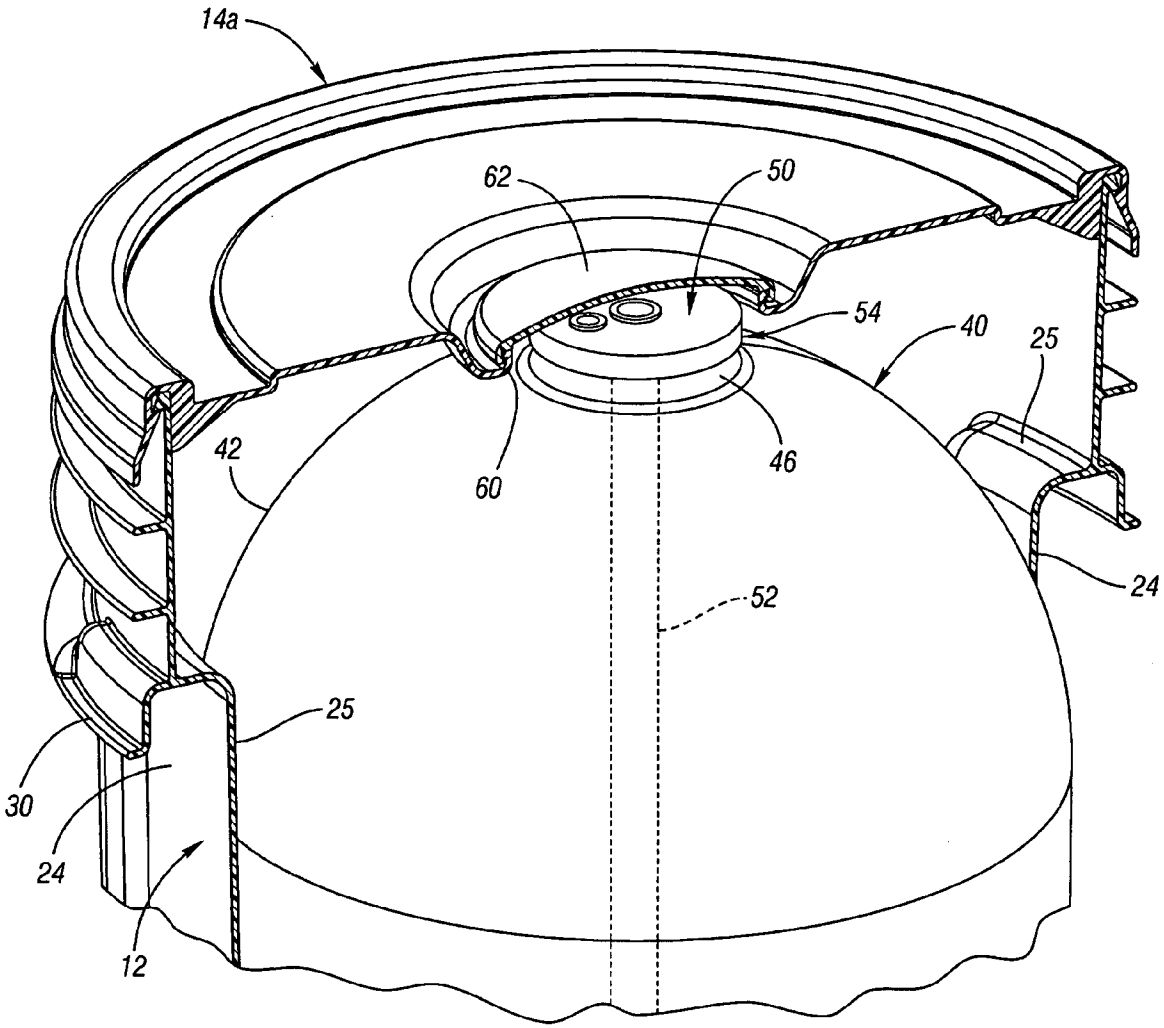
FIG. 7 is an enlarged view of the upper end of the container of FIG. 1 with the outer container and lid partially broken away, and illustrating an alternate lid.

FIG. 7 illustrates an alternate lid 14A, which can be used in the plastic beer keg 10 of FIGS. 1-6. The alternate lid 14A includes a removable cap 62 secured over a central opening 60 through the lid 14A. Thus, with the alternate lid 14A, the lid 14A can be replaced onto the container 12 (optionally, after filling the container 12 with ice) and a tap can be connected to the valve/spear assembly 50 for accessing the contents of the liner 40. The cap 62 can have a snap-fit or threaded connection with the central opening 60 in the lid 14A.

Figure 8:
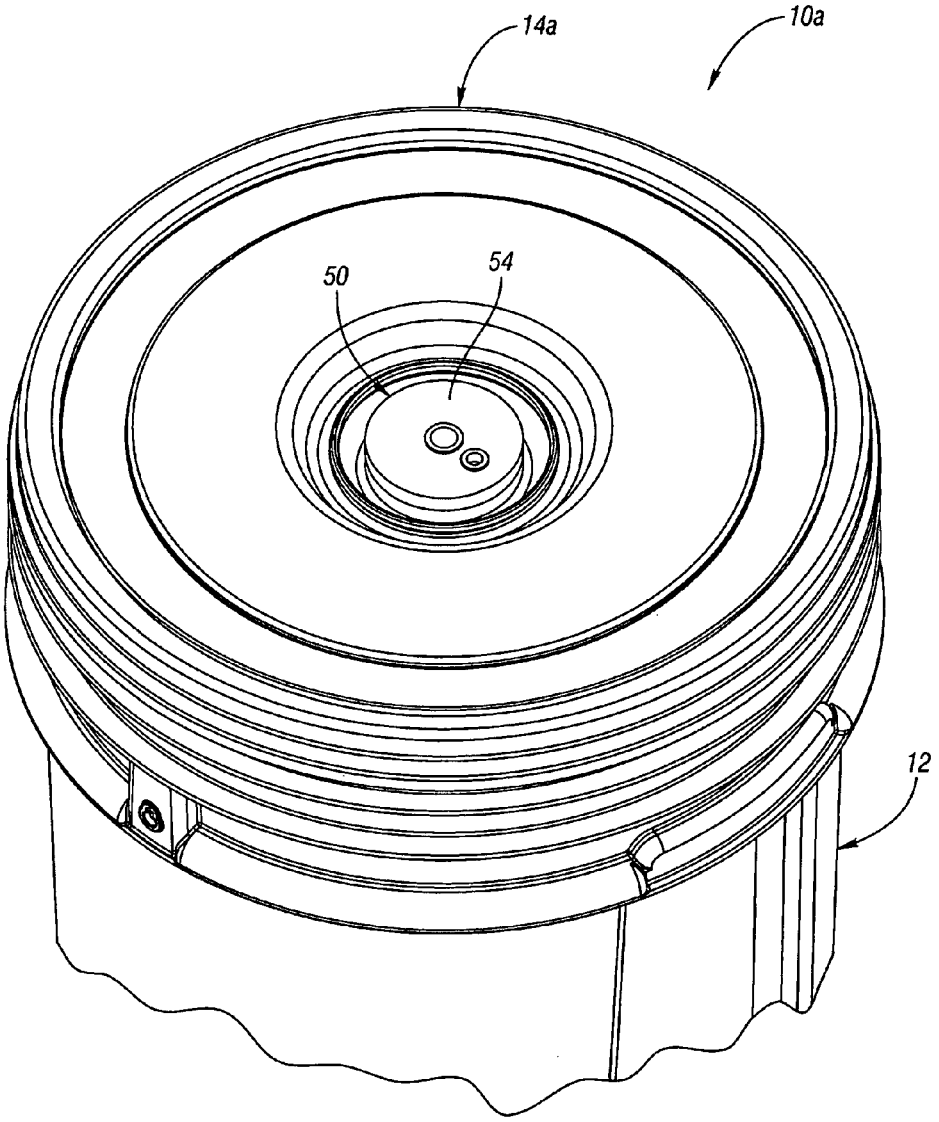
FIG. 8 is a perspective view of the upper end of the plastic keg of FIG. 7 with the cap of the lid removed.

FIG. 8 is a perspective view of the keg 10 with the alternate lid 14A with the cap 62 removed, thereby exposing the valve 54 for connection to a tap.

Figure 9:
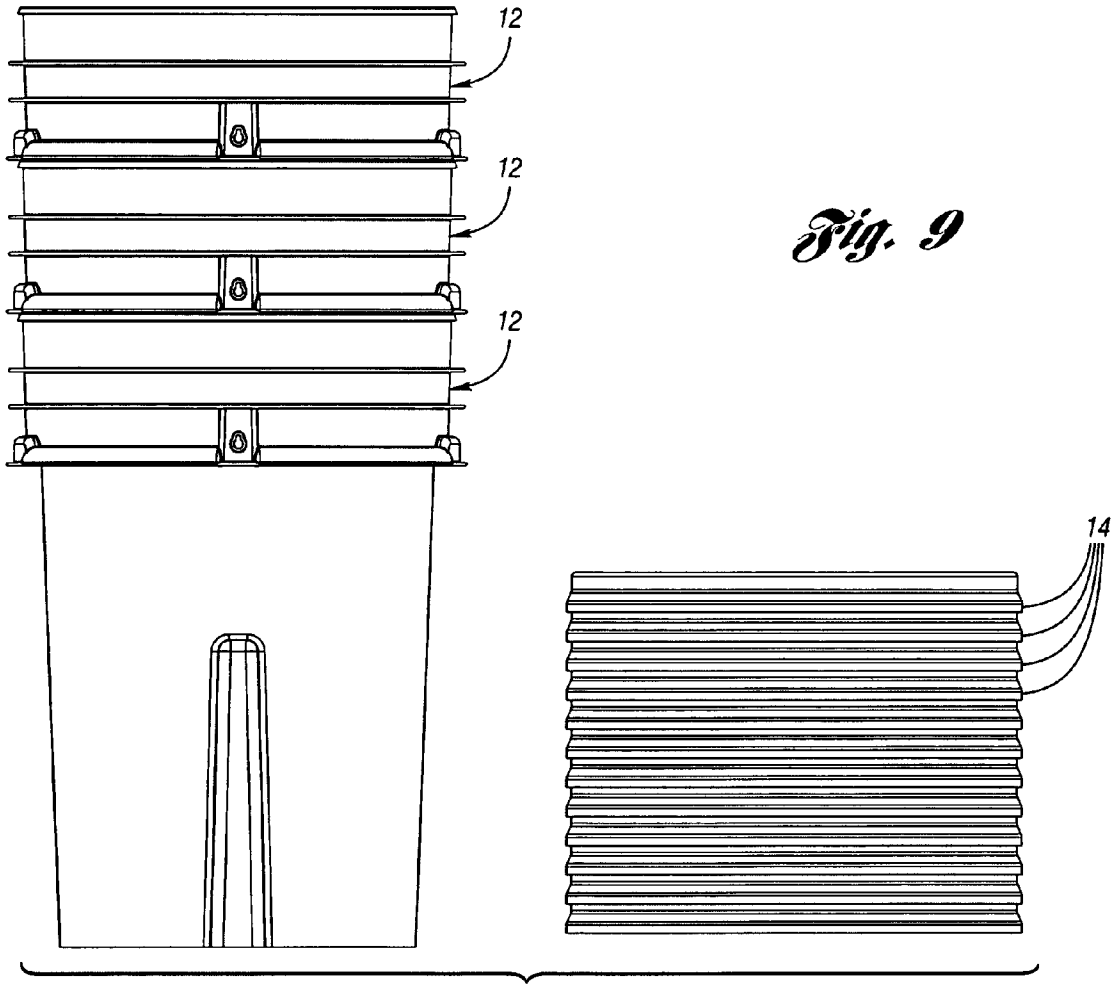
FIG. 9 illustrates a plurality of outer containers nested with one another and a plurality of lids nested with one another.
Figure 10:
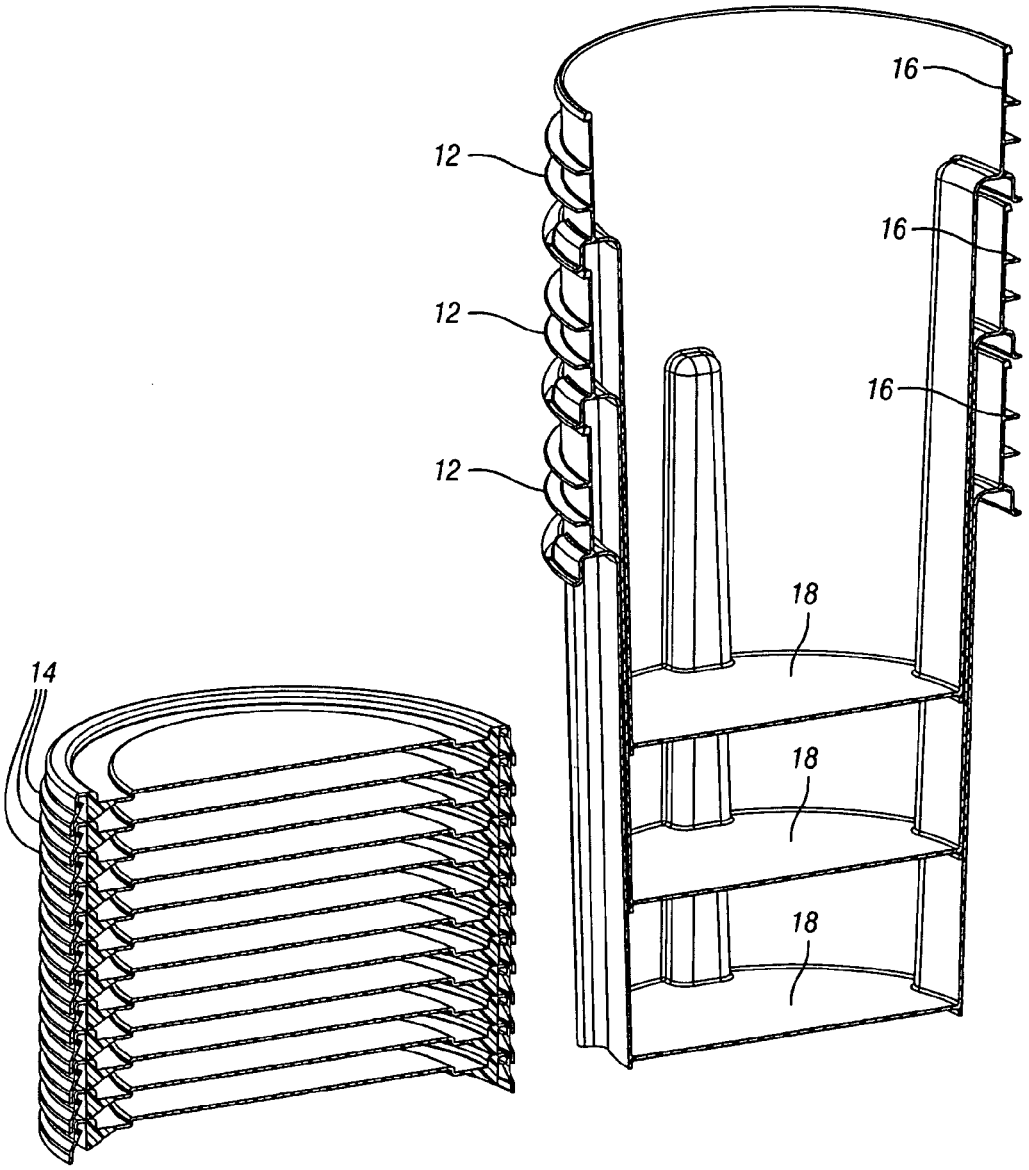
FIG. 10 illustrates the containers and lids of FIG. 9 partially broken away.

As shown in FIG. 9, prior to filling, or after removal of an empty liner 40 by the user, empty containers 12 can be nested within one another, thus reducing their overall stacking height. Further, the lids 14 are also stackable and partially nestable, as shown. FIG. 10 illustrates the containers 12 and lids 14 of FIG. 9, partially broken away to shown nesting.

Figure 11:
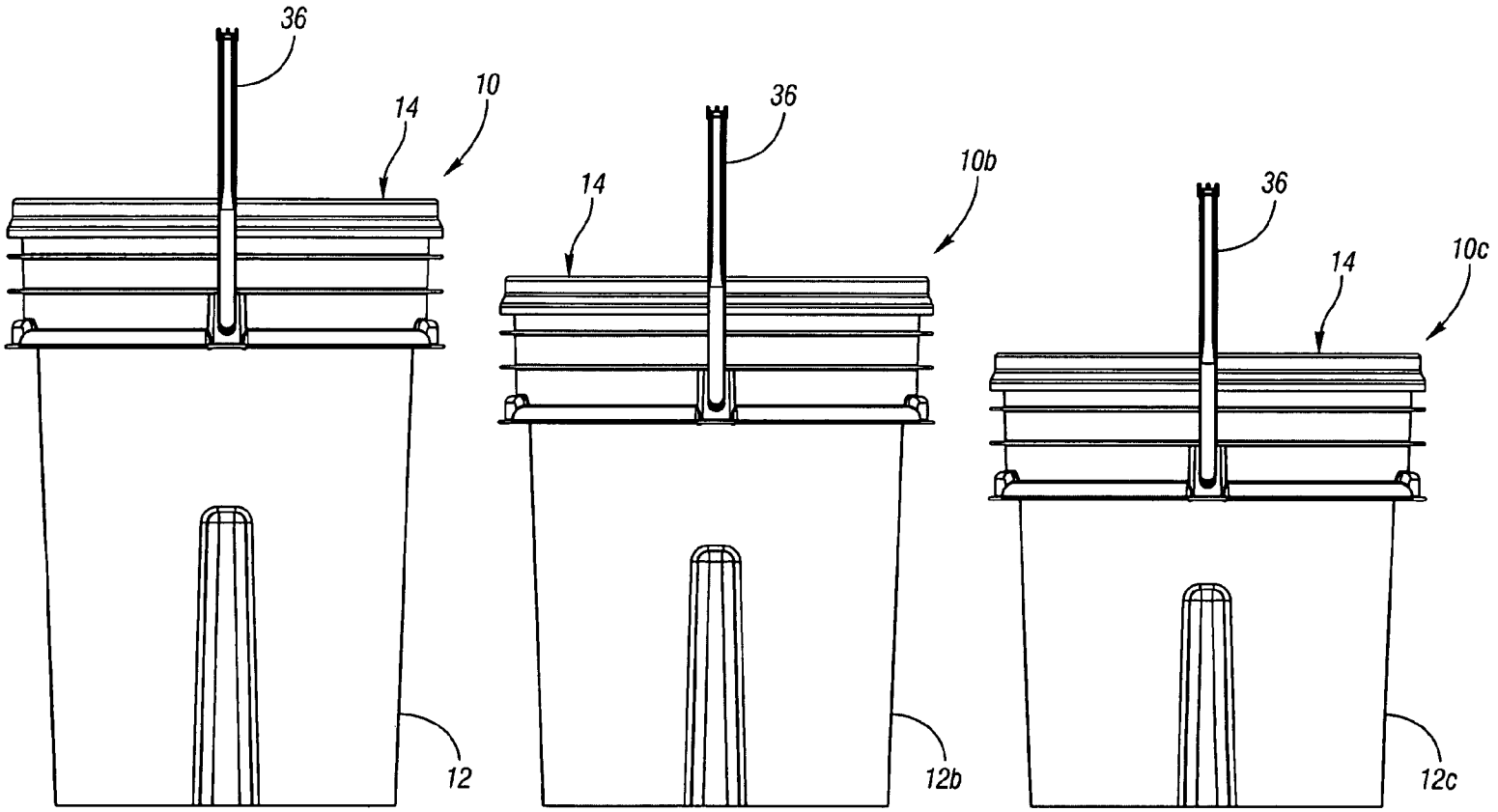
FIG. 11 is a side view of the container 10 of FIG. 1 as well as alternate size containers.

As shown in FIG. 11, the containers 12 can be provided in different sizes (container 12B and container 12C) to provide different sizes of beer kegs (beer kegs 10B and 10C).

Figure 12:
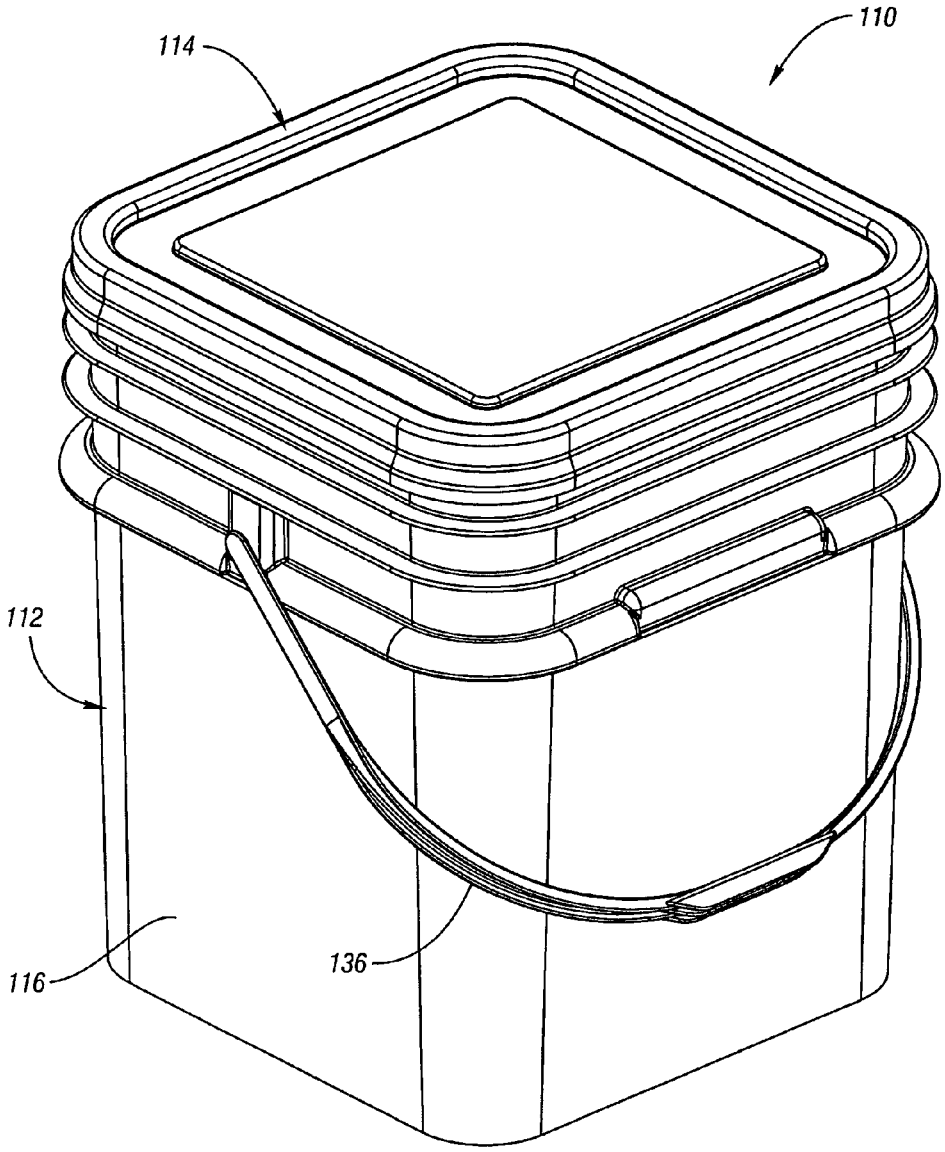
FIG. 12 is a perspective view of a plastic keg according to a second embodiment of the present invention.
Figure 13:
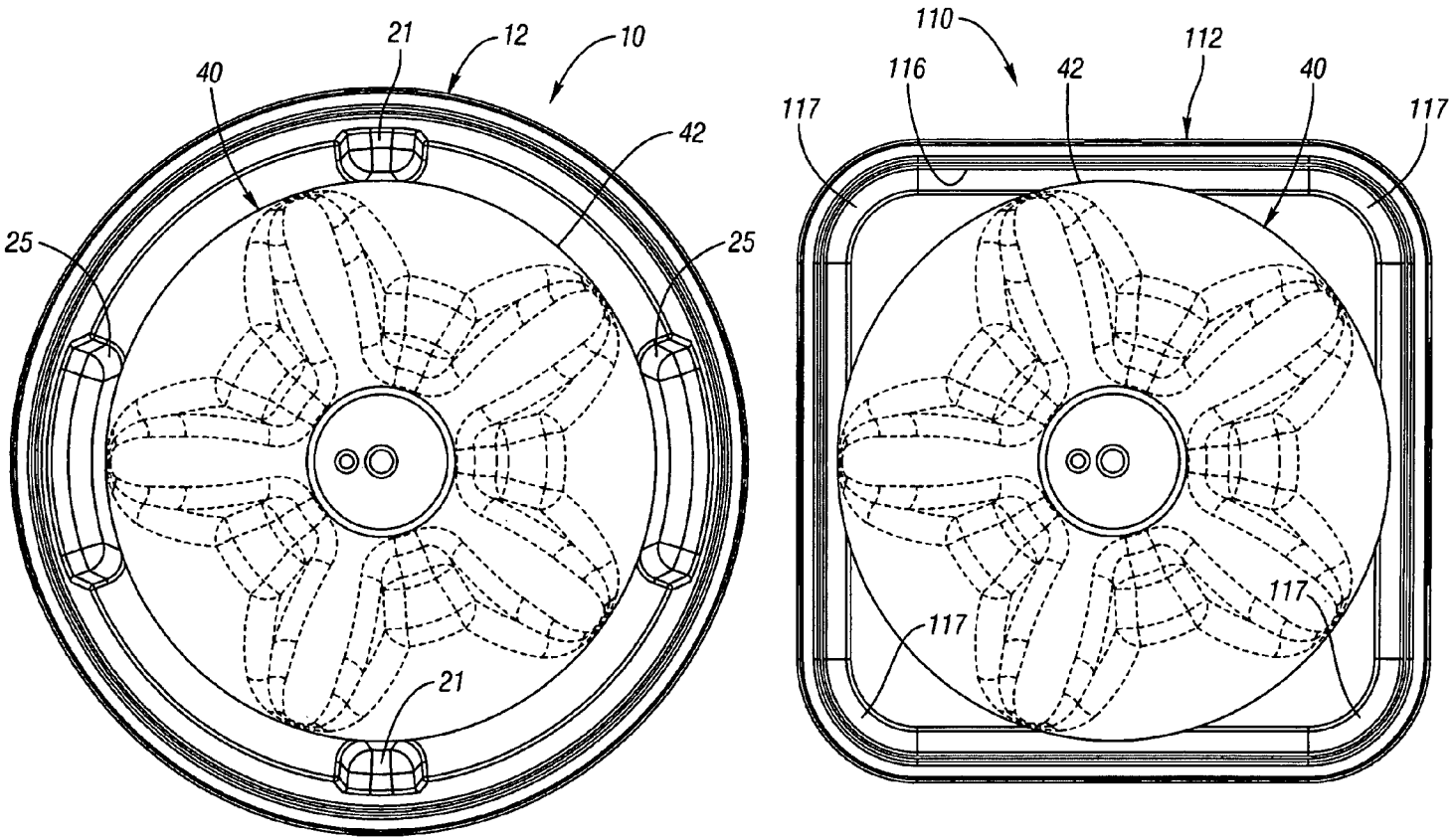
FIG. 13 is a top view of the plastic keg of the first embodiment and the plastic keg of the second embodiment with the lids removed for comparison.

FIG. 12 illustrates a beer keg 110 according to a second embodiment of the present invention. Generally, the beer keg 110 includes a generally rectangular, preferably square, container 112 having a generally square container wall 112 and corresponding lid 114. As shown in FIG. 13, the same liner 40 can be placed in the beer keg 110. Because the container 112 is square, large gaps between the liner wall 42 and the container wall 116 are provided in the corners 117. However, the overall dimensions of the container 112 are smaller than those of the container 12 of the beer keg 10 (i.e. the width of the container 110 is smaller than the diameter of the container 10), both shown in FIG. 13 for comparison. Thus, a given number of beer kegs 110 would take up less room than would the same number of beer kegs 10. The beer keg 110 would be used in the same way, i.e. dumping ice directly on the liner 40, which would flow between the liner wall 42 and container wall 116 for rapid cooling. The container 112 is reusable or recyclable and is nestable with similar containers 112. The liner 40 is recyclable. The beer keg 110 otherwise works similarly to the beer keg 10.

Figure 14:
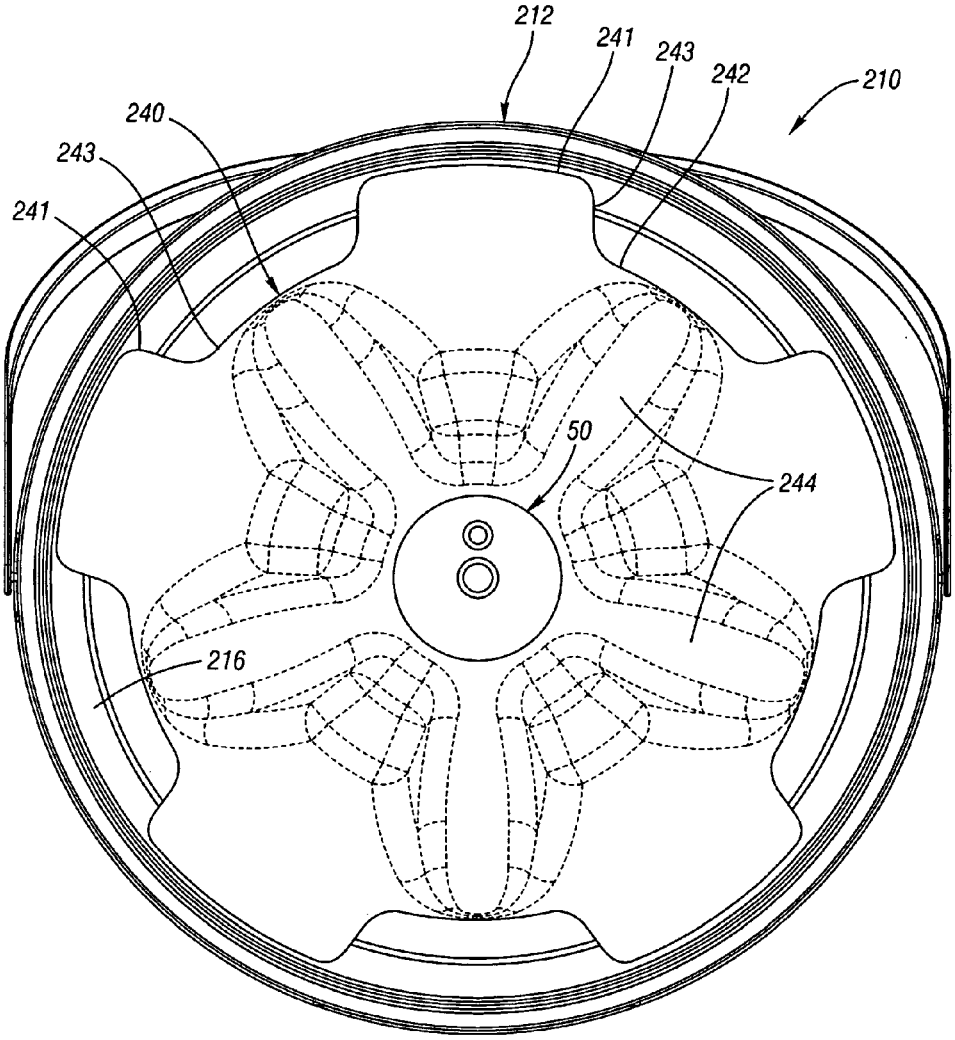
FIG. 14 is a top view of the plastic keg according to a third embodiment of the present invention (lid removed).

FIG. 14 is a top view of the plastic keg 210 according to a third embodiment of the present invention (lid removed). Generally the plastic keg 210 is formed and used the same as the kegs of the first two embodiments except as specifically shown or described. The container 212 has a generally cylindrical wall 216 without the stepped-in portions or corrugations. Instead, in order to provide spacing between the liner 240 and the container wall 216, the liner is provided with vertical corrugations, or alternating stepped-out portions 241 and recessed portions 243 (or, alternating portions of increased and decreased diameter). The relative sizes of the stepped-out portions 241 and recesses 243 may vary depending up blow molding techniques. This provides a liner 240 with a higher volume in a container 212 of the same diameter as the first and second embodiments, namely, the increased volume of the stepped-out portions 241. The liner 240 includes feet 244 at the lower end of the liner 240, as in the first and second embodiments, and has a valve/spear assembly 50 secured to the upper end of the liner 240. The plastic keg 210 would also have a lid 14 (FIG. 1) or lid 14*a* (FIG. 7).

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric identifiers on method claim steps are for ease of reference in dependent claims and do not signify a required sequence unless otherwise specified.

What is claimed is:

1. A plastic beer keg including:

a container having a base and a wall extending upward from a periphery of the base; and a liner within the container, wherein a spacing between the liner and the container varies around a periphery of the liner, wherein the periphery is defined generally parallel to the base, to a portion of increased spacing defining at least one vertical gap between the liner and the container, wherein the vertical gap is elongated vertically upward relative to the liner and the container, wherein the base is generally round and wherein the wall includes at least one portion of reduced diameter defining at least one recess below a portion of larger diameter defining a handle on an exterior of the container above the recess and wherein the at least one portion of reduced diameter contacts the liner to define the at least one vertical gap on an interior of the container adjacent the at least one portion of reduced diameter.

2. The plastic beer keg of claim 1 further including a valve assembly secured to a mouth of the liner.

3. The plastic beer keg of claim 1 wherein the container includes at least one corrugation formed in the wall, the at least one corrugation forming the at least one vertical gap.

4. The plastic beer keg of claim 1 wherein the container has a cross section parallel to the base having at least one corner, and wherein the at least one gap is defined in the at least one corner.

5. The plastic beer keg of claim 4 wherein a cross section of the container parallel to the base is generally rectangular.

6. The plastic beer keg of claim 1 further including a removable lid secured to an upper edge of the wall, enclosing the liner.

7. The plastic beer keg of claim 1 wherein the liner is PET.

8. The plastic beer keg of claim 1 further including a handle pivotably secured to the wall.

9. The plastic beer keg of claim 1 wherein the liner includes a plurality of feet formed at a lower end thereof.

10. The plastic beer keg of claim 1 wherein the wall of the container is tapered such that the container is nestable with a similar container when empty.

11. The plastic beer keg of claim 10 wherein the wall includes a plurality of recesses formed in an exterior thereof, each of the recesses defining a stepped-in portion protruding into an interior of the container, the liner fitting snugly between the stepped-in portions of the wall, the at least one vertical gap includes a plurality of vertical gaps defined adjacent the stepped-in portions, at least two of the plurality of recesses having handles defined at upper ends thereof by portions of the wall having a larger diameter.

12. The plastic beer keg of claim 1 wherein the liner includes at least one vertical recessed portion defining the at least one vertical gap.

13. The plastic beer keg of claim 1 wherein the liner includes a plurality of alternating portions of increased and decreased diameter defining the at least one vertical gap.

14. A plastic beer keg including:

a container having a base and a wall extending upward from a periphery of the base, the wall of the container being tapered such that the container is nestable with a similar container when empty, wherein the base is generally round and wherein the wall includes at least one recess below a portion of larger diameter defining a handle on an exterior of the container and wherein the at least one recess forms at least one vertical gap on an interior of the container;

a liner within the container, the liner including a mouth opening into an interior of the liner;

a valve secured to the mouth; and a spear extending from the valve to a lower end of the interior of the liner.

15. The plastic beer keg of claim 14 wherein the container includes at least one corrugation formed in the wall, the at least one corrugation elongated vertically upward relative to the container and forming at least one vertical gap between the wall and the liner, the at least one vertical gap extending from a mouth of the container to the base of the container.

16. The plastic beer keg of claim 14 wherein the container has a cross section generally parallel to the base having at least one corner.

17. The plastic beer keg of claim 14 further including a removable lid secured to an upper edge of the wall, enclosing the liner.

18. The plastic beer keg of claim 14 wherein the liner is PET.

19. The plastic beer keg of claim 14 wherein the liner is tapered to match the wall of the container.

20. A plastic beer keg including:

a container having a base and a wall extending upward from a periphery of the base, wherein the base is generally round and wherein the wall includes at least one recess below a portion of larger diameter defining a handle on an exterior of the container and wherein the at least one recess forms at least one vertical gap on an interior of the container;

a liner within the container, the liner including an opening into an interior of the liner;

a spear extending from a valve to a lower end of the interior of the liner; and a lid removably secured to the container, thereby enclosing the container, wherein the lid is removable and re-securable to an upper edge of the wall of the container.

21. The plastic beer keg of claim 20 further including at least one vertical gap between the liner and the container, the at least one vertical gap extending from a mouth of the container to the base of the container.

22. The plastic beer keg of claim 20 wherein the container has a cross section generally parallel to the base having at least one corner.

23. The plastic beer keg of claim 20 wherein the liner is PET.

24. The plastic beer keg of claim 14 wherein the wall of the container includes a radially outward projection, wherein the container is nestable up to the radially outward projection within the similar container when empty.

25. The plastic beer keg of claim 14 wherein the wall of the container is tapered down to the base.

26. The plastic beer keg of claim 14 wherein a tapered portion of the wall is nestable within the tapered portion of the wall of the similar container when empty.

27. The plastic beer keg of claim 14 wherein the container and the liner are plastic.

28. The plastic beer keg of claim 20 wherein the container and the lid are plastic.

29. The plastic beer keg of claim 28 wherein the lid snap-fits over an uppermost edge of the wall of the container.

30. The plastic beer keg of claim 29 wherein the wall of the container tapers from the upper edge down to the base such that the container is nestable with an identical container when empty.

* * * * *